US007401942B1

(12) United States Patent
Verfuerth et al.

(10) Patent No.: US 7,401,942 B1
(45) Date of Patent: Jul. 22, 2008

(54) FEMALE ELECTRIC CONNECTOR PLUG APPARATUS FOR AND METHOD OF ATTACHMENT TO FLOURESCENT TUBE LUMINAIRE FIXTURE ASSEMBLY

(75) Inventors: Neal R. Verfuerth, Random Lake, WI (US); Michael J. Potts, Plymouth, WI (US)

(73) Assignee: Orion Energy Systems, Inc., Plymouth, WI (US)

( * ) Notice: Subject to any disclaimer, the term of this patent is extended or adjusted under 35 U.S.C. 154(b) by 425 days.

(21) Appl. No.: 10/361,991

(22) Filed: Feb. 11, 2003

(51) Int. Cl.
*F21S 4/00* (2006.01)

(52) U.S. Cl. ..... 362/217; 362/260; 362/640; 362/220; 362/224; 362/225

(58) Field of Classification Search ..... 362/226, 362/260, 262, 217, 221, 147, 148, 220, 224–225, 362/640, 657
See application file for complete search history.

(56) References Cited

U.S. PATENT DOCUMENTS 2,619,583 A 11/1952 Baumgartner ..... 240/51.11
3,247,368 A 4/1966 McHugh ..... 240/51.11
4,001,571 A * 1/1977 Martin ..... 315/189
4,287,456 A * 9/1981 Kovacik et al. ..... 315/283
4,674,015 A 6/1987 Smith ..... 362/217
4,928,209 A 5/1990 Rodin ..... 362/217
5,112,241 A * 5/1992 Chesnut et al. ..... 439/273
5,249,982 A * 10/1993 Funck et al. ..... 439/556
6,091,200 A * 7/2000 Lenz ..... 315/159

* cited by examiner

*Primary Examiner*—Jacob Y Choi
(74) *Attorney, Agent, or Firm*—Foley & Lardner LLP

(57) ABSTRACT

This invention is for electric power line attachment apparatus to hanging luminaire including fluorescent tube luminaire assembly, and includes a female connector attached to the luminaire and a power line connector cord male segment plugged into the female segment attached to the luminaire and the female segment and male segment of the connector cord is preferably a UNIVERSAL MATE-N-LOK insulated connector which is a trademark of AMP CO., a division of Tyco Co. of Harrisburg, Pa.

13 Claims, 4 Drawing Sheets

FEMALE ELECTRIC CONNECTOR PLUG APPARATUS FOR AND METHOD OF ATTACHMENT TO FLOURESCENT TUBE LUMINAIRE FIXTURE ASSEMBLY

BACKGROUND OF THE INVENTION

Luminaires intended to be hung from a ceiling have a cord for connection to an electric power line as part of the complete assembly, and having such an attached cord presents a problem of handling while hanging the luminaire assembly, and to obviate such a problem this present invention eliminates the attached connector cord, and instead there is mounted on the spine of the luminaire a female plug apparatus, and this female plug segment to accept a male plug attached to the electric power line source.

SUMMARY OF THE INVENTION

This invention discloses and claims a luminaire and having a female plug mounted on the spine in the back of the luminaire, which female plug may be a conventional female receptacle or preferably a female UNIVERSAL MATE-N-LOK which is a trademark of AMP division of TYCO ELECTRONICS CORPORATION, OF HARRISBURG, PA. The economic advantage of this invention is that a connector cord from the power line to the installed hanging fluorescent luminaire fixture assembly can be made for the proper length for the power line connection without having to cut or splice the power line connector when assembled to the fluorescent fixture assembly, prior to hanging the fixture.

OBJECTS OF THIS INVENTION

An object of this invention is to disclose and claim a luminaire light assembly having a female connector segment mounted on the luminaire and wired to the lights of the luminaire and the female connector segment to accept a mating insulated power line male plug connector segment.

Another object is to disclose and claim a fluorescent tube light luminaire assembly, having a female connector segment mounted on the fluorescent luminaire light assembly, and this female connector segment wired to ballast and light tubes and to accept a mating power line electrically insulated male plug connector segment.

LEGENDS DESCRIPTIONS

1 Luminaire fixture assembly.
2 UNIVERSAL MATE-N-LOK female segment.
3 Spine of luminaire fixture assembly.
3' Top surface of spine of luminaire fixture assembly.
4 Light tube reflectors in luminaire fixture assembly.
4' Top convex surface of reflectors in luminaire fixture assembly.
5 Sockets for fluorescent tube plug in.
6 Socket mount/wire raceway.
7 Flexible tooth leg.
8 Hanger chain attachment.
9 Electric power lines from female UNIVERSAL MATE-N-LOK segment to ballast/fluorescent light tubes in light fixture. assembly
9' Electric power lines to ballast/fluorescent light tubes in prior art fluorescent tube light fixture assembly.
10 Hanger chain or cord.
11 UNIVERSAL MATE-N-LOK male segment.
12 Connector cord from electric power source to UNIVERSAL MATE-N-LOK female segment to fluorescent tube lights in fixture assembly.
13 Protrusion bumper stop on female segment of UNIVERSAL MATE-N-LOK connector.
14 Prior art connector cord wire attached to fluorescent light fixture assembly.
15 Aperture in the back of luminaire assembly.

DETAILED DESCRIPTION OF INVENTION

Figure 1:
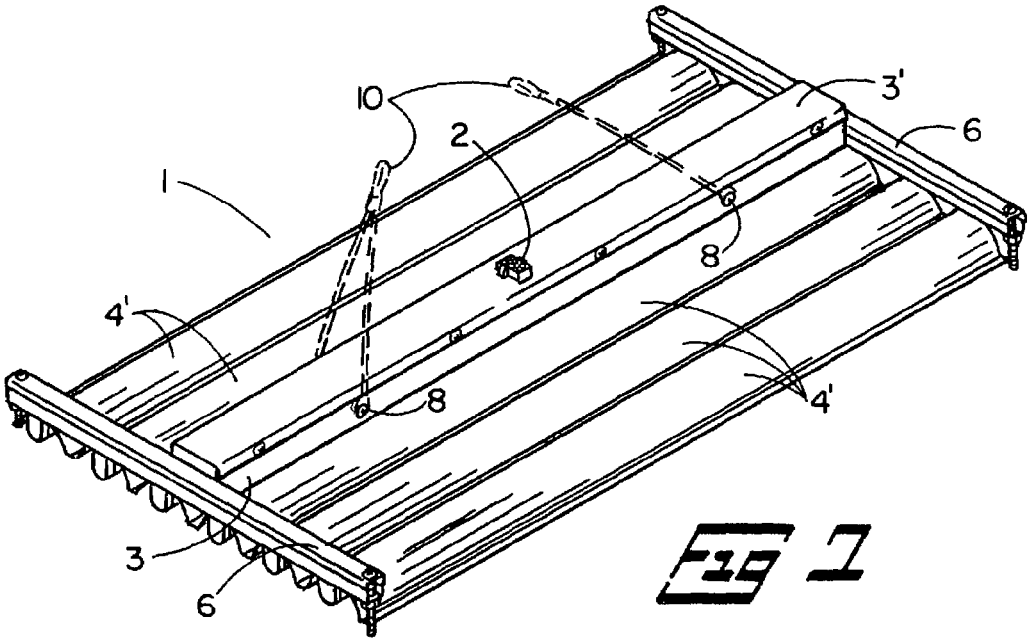
FIG. 1. Perspective view of top of fluorescent tube luminaire fixture assembly.
Figure 2:
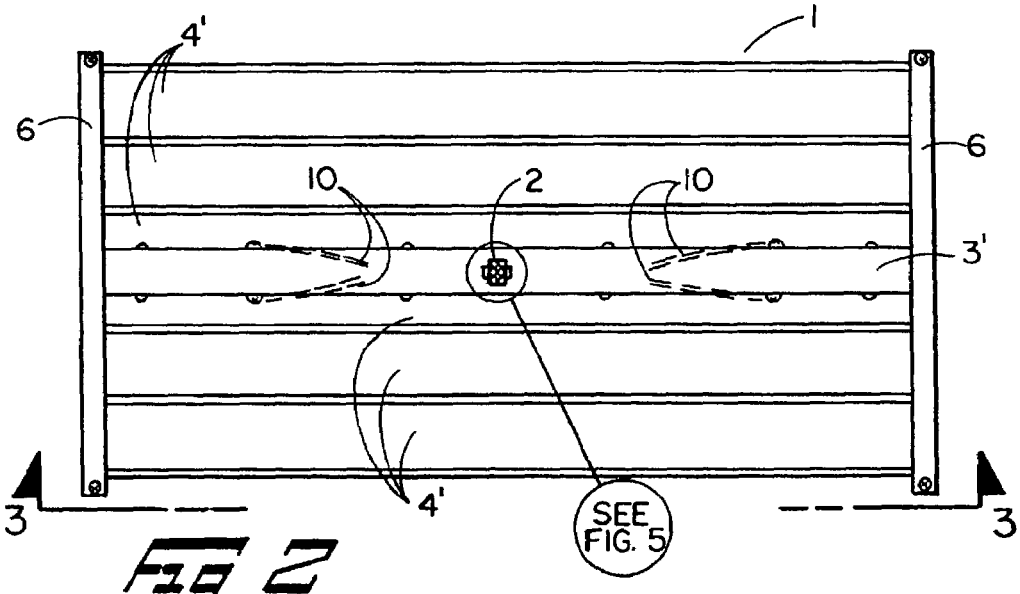
FIG. 2. Plan view of top of fluorescent tube luminaire fixture assembly.
Figure 3:
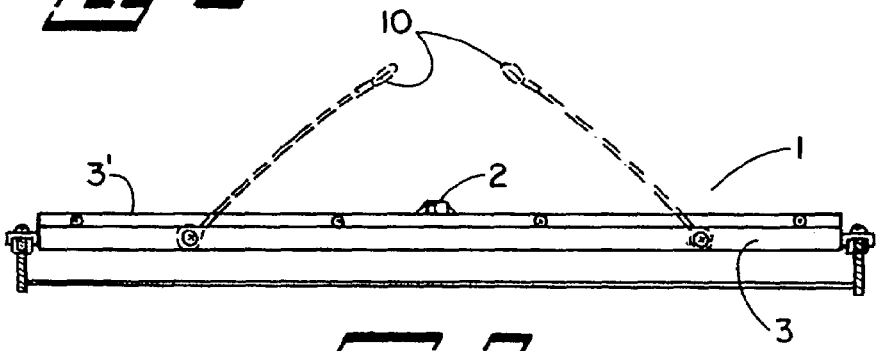
FIG. 3. Side elevation view of fluorescent tube luminaire fixture assembly.

This invention discloses apparatus and method of assembly of a luminaire fixture assembly, 1, FIGS. 1, 2, and 3 having a universal MATE-N-LOK female segment electrical plug 2, mounted on the back of the luminaire, as shown in FIG. 1, perspective view, FIG. 2, plan view of top of fluorescent tube luminaire fixture assembly 1, and FIG. 3 side elevation view of fluorescent tube luminaire fixture assembly. As shown in FIGS. 1, 2, and 3, the universal MATE-N-LOK female segment 2, is mounted on the back or top side of the fluorescent tube luminaire fixture assembly 1, in the top surface 3' of spine 3, of the luminaire fixture assembly 1. Hanger chain or cord 10 may be attached by hanger chain/cord attachment 8 to the spine 3 to facilitate hanging of the fluorescent tube luminaire fixture assembly 1. Reflectors 4 for down lighting are shown in FIGS. 1 and 2 which show the convex side of the reflectors assembly, in the luminaire assembly. The sockets 5 for fluorescent tube plug in and socket mount/wire raceway 6 are shown in FIG. 1.

Figure 4:
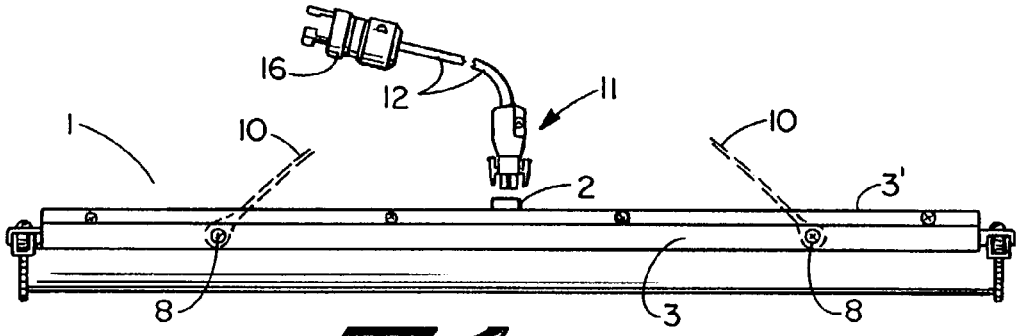
FIG. 4. Elevation view of fluorescent tube luminaire fixture assembly and connector cord with male ends only.
Figure 7:
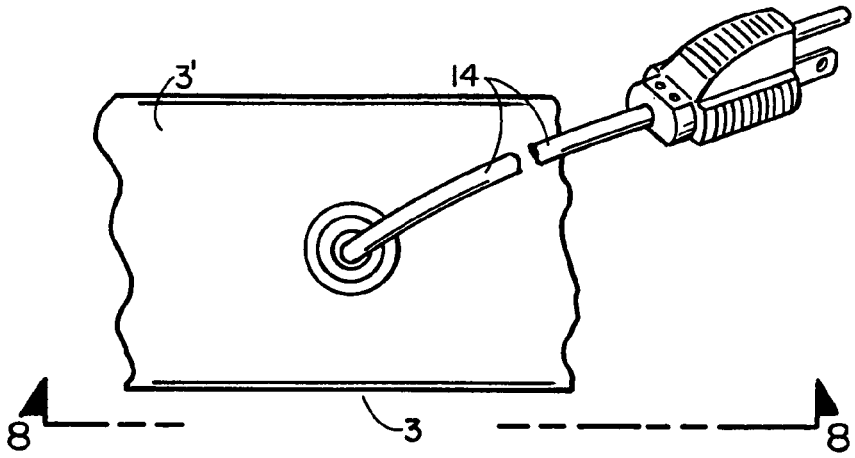
FIG 7 PRIOR ART
FIG. 7. Plan view of prior art with connector cord attached to spine of fluorescent tube luminaire fixture assembly.
Figure 8:
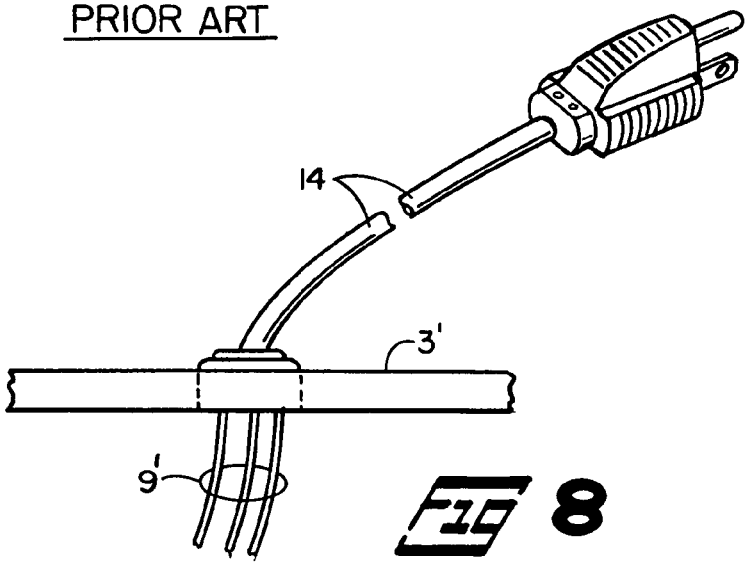
FIG 8 PRIOR ART
FIG. 8. Elevation view of prior art with connector cord attached to spine of fluorescent tube luminaire fixture assembly.
Figure 11:
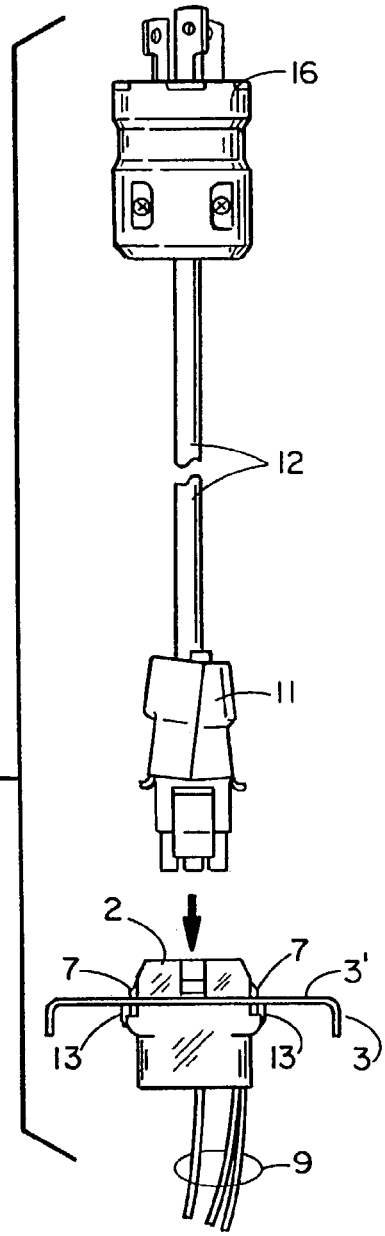
FIG. 11 Alignment assembly of UNIVERSAL MATE-N-LOK connector cord male end segment to plug into UNIVERSAL MATE-N-LOCK female segment.

Reference is now made to FIGS. 7 and 8 showing prior art segments, with the power line 14 attached to the spine 3 of the fluorescent tube luminaire assembly 1, and the electric power lines 9' to ballast/fluorescent light tubes in light-fixture assembly. This present invention then obviates the necessity of having a dangling electrical connector cord, as shown in prior art FIGS. 7 and 8. attached to the fluorescent tube luminaire fixture assembly, and further, the connector cord 12, of this invention having a male plug 16 to plug into the power supply outlet, and on the opposite of the connector cord, a MATE-N-LOK male connector 11 to plug into the female connector 2 component mounted in the back or spine 3 of luminaire fixture assembly Reference is now made to FIG. 4, showing a side elevation view of this present invention of luminaire fixture assembly 1, and spine 3 of luminaire fixture assembly 1, and universal MATE-N-LOK female segment 2, attached to the spine 3 of luminaire fixture assembly 1. The connector cord 12, (see FIGS. 4 and 11) from electric power source to MATE-N-LOK female segment has a male plug 11, to plug into electric power source and a universal MATE-N-LOK male segment 11, and this male segment 11 to plug into universal MATE-N-LOK female segment 2, attached to the spine 3 of luminaire fixture assembly 1.

Figure 5:
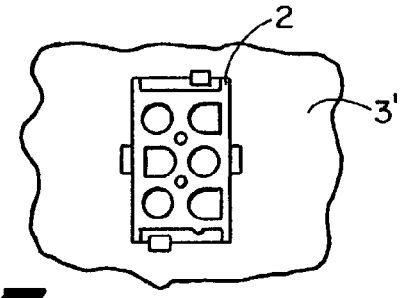
FIG. 5. Isolated plan view of female UNIVERSAL MATE-N-LOK plug mounted on back spine of fluorescent tube luminaire fixture assembly.
Figure 6:
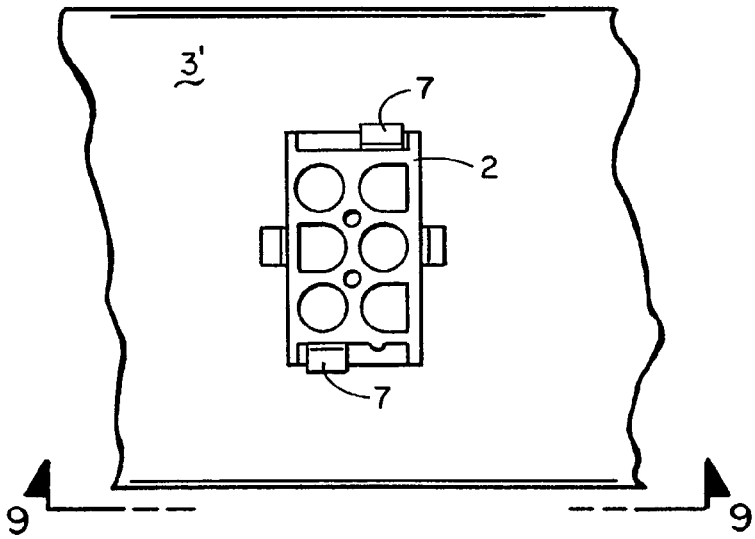
FIG. 6. Enlarged plan view of female UNIVERSAL MATE-N-LOK plug segment mounted on spine of fluorescent tube luminaire fixture assembly.

FIG. 5 is a small plan view of universal MATE-N-LOK female segment 2, mounted in the spine 3 of luminaire fixture assembly. FIG. 6 is an enlarged plan view of universal MATE-N-LOK female segment 2 mounted in spine 3 of luminaire fixture assembly 1, and flexing toothed arms 7, ride on edges of spine 3 of luminaire fixture assembly 1, and holds iniversal MATE-N-LOK female segment in aperture 15 (see FIGS. 10 and 11) of the spine 3 of luminaire fixture assembly, in conjunction with the protrusion bumper stop 13. on female segment 2 of universal MATE-N-LOK connector.

Figure 9:
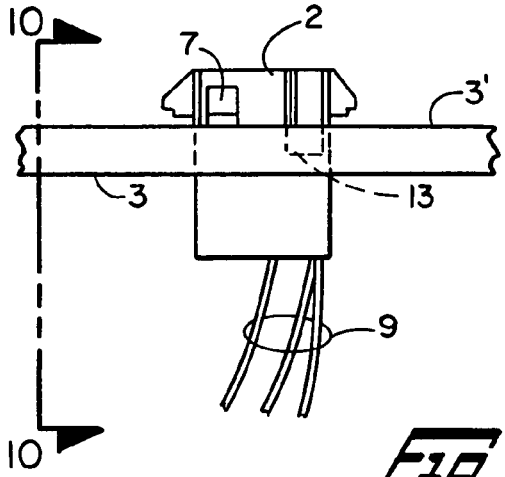
FIG. 9. Elevation view of female UNIVERSAL MATE-N-LOK segment mounted in spine of fluorescent tube luminaire fixture assembly.
Figure 10:
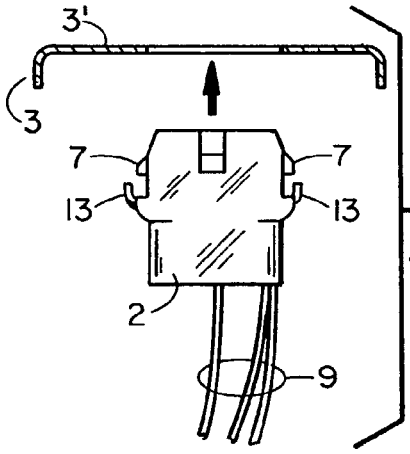
FIG. 10 Elevation view of female universal MATE-N-LOK segment to snap fit into aperture in spine of fluorescent tube luminaire fixture.
Figure 12:
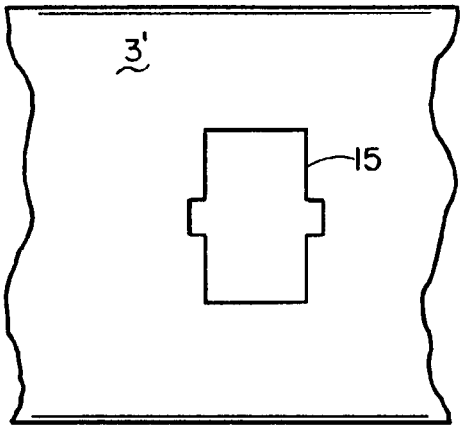
FIG. 12 Segment of spine and aperture for female UNIVERSAL MATE-N-LOK segment.

Referring to FIG. 9, which is a side elevation view of universal MATE-N-LOK female segment 2, mounted in aperture 15 of spine 3. of luminaire fixture assembly 1, and protrusion bumper stops 13 of universal MATE-N-LOK female segment shown by dashed lines. FIG. 10 shows the alignment of universal MATE-N-LOK female segment 2 with the aperture 15 in spine of luminaire fixture assembly 3, and protrusion bumper stops 13 on the outer periphery of the MATE-N-LOK female segment 2, and flexible leg tooth 7 of this female segment 2, contacting the outer rim surface of the aperture 15 in spine 3 of luminaire fixture assembly 1, and FIG. 9 shows the universal MATE-N-LOK female segment 2, mounted in spine 3 of luminaire fixture assembly and held in the aperture 15 (see FIG. 12) by protrusion bumper 13 shown by dashed lines on under side of the spine 3 of luminaire fixture assembly and by flexible leg tooth 7 on the outer surface of the spine 3 to thus hold the universal MATE-N-LOK female segment 2 in the aperture 15 of the spine 3. of luminaire assembly. Hereinafter UNIVERSAL MATE-N-LOK segments male and female may be referred to as "MATE-N-LOK" male or female segments.

The power lines 9, of this present invention, extend from female MATE-N-LOK connector to the ballast and fluorescent tubes and become the power source when the male MATE-N-LOK segment 11, of connector cord 12, is plugged into the female MATE-N-LOK connector segment, which is in contrast to the prior art power lines 9' which are connected to the power connector cord 14, see FIGS. 7 and 8.

In the discussion and claims, a hanging fluorescent tube luminaire assembly, may also be described in the alternative as, fluorescent tube luminaire fixture assembly, or luminaire fixture assembly.

Referring now to prior art, FIGS. 7 and 8, one size (length) of prior art connector cord 14 does not fit all installation situations thus having connector cords 12 from electric power source to MATE-N-LOK female segment as a separate component makes for better economy from the standpoint of ease of installation, and economy of lengths of connector cord 12 in various situations.

"Fluorescent tube" is meant to include conventional fluorescent light tubes, and the term "light fixture" is synonymous with "fixture assembly".

The prior art patents cited do not singly anticipate, or collectively obviate this present invention.

We claim:

1. A fluorescent tube luminaire fixture assembly comprising:

a reflector assembly comprising a bottom side adapted to reflect light from a fluorescent tube and a top side opposite the bottom side;

a first raceway coupled to the reflector assembly and configured to secure a first end of the fluorescent tube such that the fluorescent tube is adjacent to the bottom side of the reflector assembly;

a second raceway coupled to the reflector assembly and configured to secure a second end of the fluorescent tube;

a spine coupled to the top side of the reflector assembly and extending between the first raceway and the second raceway;

a female electric plug mounted to the spine; and a connector cord comprising a first male electric plug and a second male electric plug, wherein the first male electric plug is configured to plug into an electric power source, and further wherein the second male electric plug is configured to plug into said female electric plug.

2. The fluorescent tube luminaire fixture assembly of claim 1, further comprising a spine mounted to the first and second raceways to form an I-shaped assembly.

3. The fluorescent tube luminaire fixture assembly of claim 2, wherein the female electric plug is mounted to a top surface of the spine.

4. The fluorescent tube luminaire fixture assembly of claim 1, wherein the female electric plug is mounted within an aperture in a spine which is mounted to the top side of the reflector assembly, and further wherein the female electric plug comprises a flexible leg tooth configured to secure the female electric plug through contact with a top surface of the spine.

5. The fluorescent tube luminaire fixture assembly of claim 4, wherein the female electric plug further comprises a protrusion bumper stop configured to secure the female electric plug through contact with a bottom surface of the spine.

6. A method of attaching an electric power line apparatus to a hanging fluorescent tube luminaire fixture assembly, the method comprising:

attaching a first male electric plug of a connector cord to an electric power source;

attaching a second male electric plug of the connector cord to a female electric plug, wherein the female electric plug is mounted to a spine the spine extending between a first raceway and a second raceway and coupled on a top side of a reflector assembly, the reflector assembly comprising the top side and a bottom side opposite the top side, wherein the first and second raceways are configured to secure a fluorescent tube adjacent to the bottom side, and the reflector assembly is configured to reflect light from the fluorescent tube, and further wherein the second male electric plug of the connector cord is configured to mate with the female electric plug.

7. The method of claim 6, wherein the female electric plug is mounted to a top surface of a spine which is mounted to the top side of the reflector assembly.

8. The method of claim 6, further comprising mounting the first raceway to the reflector assembly, wherein the first raceway is configured to secure a first end of the fluorescent tube such that the fluorescent tube is adjacent to the bottom side of the reflector assembly.

9. The method of claim 8, further comprising mounting the second raceway to the reflector assembly, wherein the second raceway is configured to secure a second end of the fluorescent tube such that the fluorescent tube is adjacent to the bottom side of the reflector assembly.

10. The method of claim 6, wherein a spine is mounted to the first and second raceways to form an I-shaped assembly.

11. The method of claim 10, further comprising mounting the female electric plug to a top surface of the spine.

12. The method of claim 6, further comprising mounting the female electric plug within an aperture in a spine which is mounted to the top side of the reflector assembly, and further wherein the female electric plug comprises a flexible leg tooth configured to secure the female electric plug through contact with a top surface of the spine.

13. The method claim 12, wherein the female electric plug further comprises a protrusion bumper stop configured to secure the female electric plug through contact with a bottom surface of the spine.

* * * * *